US006091796A

United States Patent [19]

Trissel et al.

[11] Patent Number: 6,091,796

[45] Date of Patent: Jul. 18, 2000

[54] SCINTILLATOR BASED MICROSCOPE

[75] Inventors: Richard Trissel, Cardiff; Steve Horton, Oceanside; Brett Spivey, Encinitas; Lee Morsell, Del Mar, all of Calif.

[73] Assignee: Thermotrex Corporation, San Diego, Calif.

[21] Appl. No.: 08/736,716

[22] Filed: Oct. 28, 1996

Related U.S. Application Data

[63] Continuation-in-part of application No. 08/622,035, Mar. 26, 1996, which is a continuation of application No. 08/344,141, Nov. 23, 1994, abandoned.

[51] Int. Cl.[7] ..... G21K 7/00

[52] U.S. Cl. ..... 378/43; 378/98.8; 250/361 R

[58] Field of Search ..... 378/43, 98.3, 98.8; 250/368, 361 R, 363.01

[56] References Cited

U.S. PATENT DOCUMENTS

| | | | |
|---|---|---|---|
| 3,758,723 | 9/1973 | Green et al. | 178/6.8 |
| 3,846,632 | 11/1974 | Rabodzei et al. | 250/312 |
| 4,628,355 | 12/1986 | Ogura et al. | 358/111 |
| 4,628,356 | 12/1986 | Spillman et al. | 358/111 |
| 4,628,357 | 12/1986 | Fenster | 358/111 |
| 4,688,241 | 8/1987 | Peugeot | 378/137 |
| 4,835,379 | 5/1989 | Carmean | 250/213 |
| 4,896,343 | 1/1990 | Saunders | 378/95 |
| 4,896,344 | 1/1990 | Grady et al. | 378/99 |
| 4,905,264 | 2/1990 | Ogura | 378/99 |
| 5,023,896 | 6/1991 | Yokouchi et al. | 378/99 |
| 5,027,380 | 6/1991 | Nishiki | 378/4 |
| 5,117,446 | 5/1992 | Haaker et al. | 378/99 |
| 5,119,411 | 6/1992 | Nakamura | 378/43 |
| 5,159,455 | 10/1992 | Cox et al. | 358/213.11 |
| 5,199,054 | 3/1993 | Adams et al. | 378/21 |
| 5,222,113 | 6/1993 | Thieme et al. | 378/43 |
| 5,235,191 | 8/1993 | Miller | 250/486.1 |
| 5,247,555 | 9/1993 | Moore et al. | 378/4 |
| 5,301,220 | 4/1994 | Wong | 348/162 |
| 5,308,986 | 5/1994 | Walker | 250/370.11 |
| 5,416,818 | 5/1995 | Takahashi et al. | 378/98.7 |

OTHER PUBLICATIONS

Kevex X–Ray, Inc., Brochure entitled X–Ray Tubes + Power Supplies, Dec. 1995.

*Primary Examiner*—Don Wong
*Attorney, Agent, or Firm*—Fish & Richardson PC

[57] ABSTRACT

A scintillation based microscope. One surface of a single crystal salt crystal scintillator is supported on an optically transparent support plate. The opposite surface, an illumination surface, of the crystal is coated with an optically reflecting material which is transparent to high energy photons (such as x-ray and/or high energy ultraviolet photons) in order to provide a scintillation sandwich having an optical mirror at the illumination surface of the crystal. These high energy photons are directed through a target to create a shadow image of the target on the illumination surface of the scintillator salt crystal. A portion or all of the shadow image is viewed with an optical device such as an eye piece to provide a very high resolution image of the target or portions of the target. In a preferred embodiment an adjustable pin hole unit is described to produce a very small x-ray spot source for producing high resolution geometric magnification of the shadow image of the target.

21 Claims, 8 Drawing Sheets

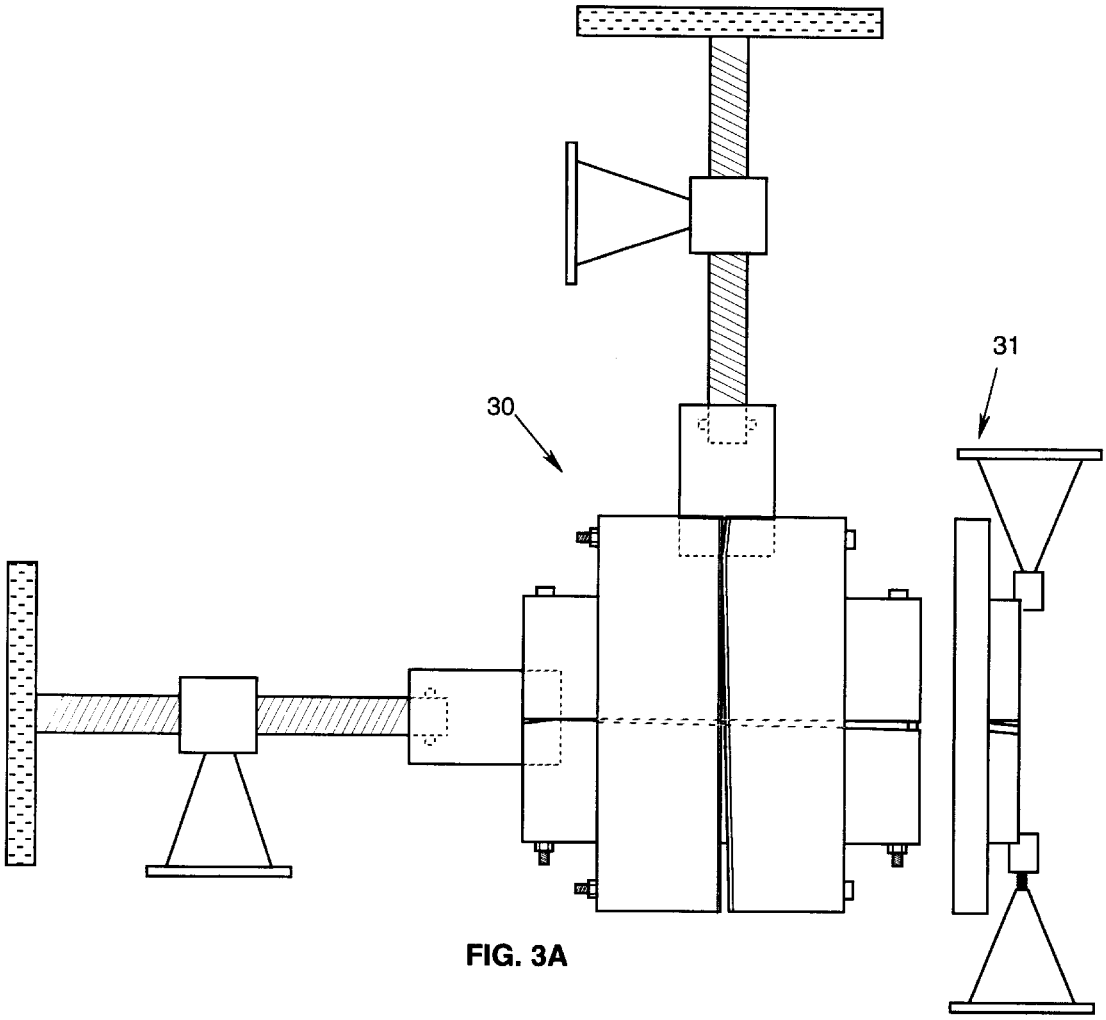
FIG. 3A
FIG. 3C
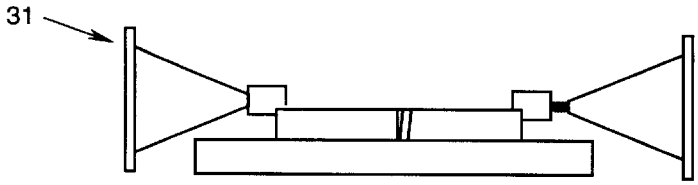
FIG. 3B

SCINTILLATOR BASED MICROSCOPE

This is a continuation-in-part application of Ser. No. 08/622,035, filed Mar. 26, 1996, which is a continuation of Ser. No. 08/344,141 filed Nov. 23, 1994, now abandoned. The present invention relates to microscopes and in particular to x-ray microscopes.

BACKGROUND OF THE INVENTION

In most microscopes, the visible light spectrum is used for imaging. X-ray microscopes are known. Two principal advantages of an x-ray microscope over a visible light microscope are (1) better potential resolution of extremely small features due to shorter wavelengths; and (2) some internal features can be observed which cannot be seen with a visible light microscope.

Most x-ray imaging devices involve directing a beam of x-rays through an object onto a phosphor screen which converts each x-ray photon into a large number of visible photons. The visible photons expose a sheet of photographic film placed close to the phosphor thus forming an image of the attenuation of x-rays passing through the object.

There are several limitations to film-screen x-ray devices. A major limitation is that the film serves the combined purpose of both the image acquisition function and the image display function. In addition, the range of contrast or latitude of the film is too limited to display the entire range of contrast in many objects of interest. Because of the limited latitude and dual acquisition/display function of film, a film-screen x-ray is often overexposed in one area and underexposed in another area due to the thickness and composition variations of the object across the image. The gray-scale level of x-ray film has a sigmoidal response as a function of exposure which results in difficulties in distinguishing contrast differences at the extremes of the exposure range; that is, in the most radiodense and in the most radiolucent areas of the image.

Digital x-ray techniques have been proposed as a technology which replaces the phosphor/film detector with a digital image detector, with the prospect of overcoming some of the limitations of film-screens in order to provide higher quality images. A potential advantage of digital x-ray technology involves the separation of the image acquisition function from the image display function. Digital detectors also provide a much greater range of contrast than film and the contrast response function is linear over the entire range. This would allow a digital detector to more easily distinguish subtle differences in attenuation of x-rays as they pass through various paths of the object. Differences in attenuation due to thickness and composition variations across the object can be subtracted out of the digital data in the computer and the residual contrast can then be optimized for the particular viewing mechanism, be it film or computer monitor. The residual contrast differences can then be analyzed to search for things of interest. Other advantages of digital x-ray technology include digital image archival and image transmission to remote location for viewing purposes.

Current digital x-ray devices have fairly limited resolution and so they are limited in their applications. What is needed is high resolution imaging devices capable of detecting microscopic internal features.

SUMMARY OF THE INVENTION

The present invention provides a scintillation based microscope. One surface of a single crystal salt crystal scintillator is supported on an optically transparent support plate. The opposite surface, an illumination surface, of the crystal is coated with an optically reflecting material which is transparent to high energy photons (i.e., high energy ultraviolet photons, x-rays and gamma rays) in order to provide a scintillation sandwich having an optical mirror at the illumination surface of the crystal. These high energy photons are directed through a target to create a shadow image of the target at or near the illumination surface of the scintillator salt crystal. A portion or all of the shadow image is viewed with a magnifying optical element such as the optical elements of a conventional optical microscope to provide a very high resolution image of the target or portions of the target. In a preferred embodiment an adjustable pin hole unit is described which produces a very small x-ray spot source for providing a high resolution geometric magnification of a shadow image of the target.

BRIEF DESCRIPTION OF THE DRAWINGS

FIGS. 3A, 3B and 3C are drawings of the adjustable pin-hole aperture device.

FIG. 5 is a sketch of a third embodiment of the present invention.

DETAILED DESCRIPTION OF PREFERRED EMBODIMENT

Figure 1:
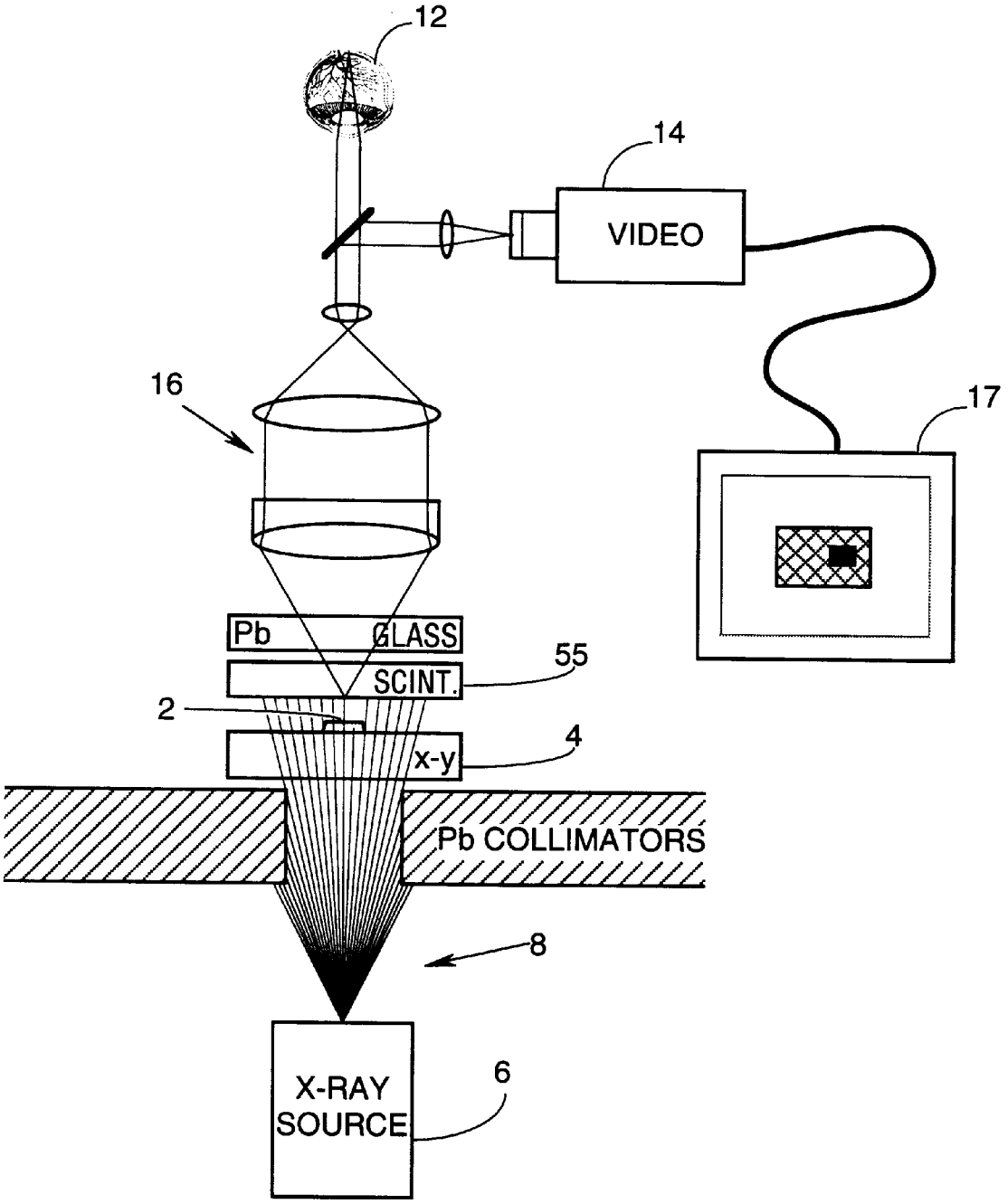
FIG. 1 is a drawing of the preferred embodiment of the present invention.

Preferred embodiments of the present invention are described below by references to the figures.

First Embodiment

A first embodiment of the present invention can be described by reference to FIG. 1. A target 2 is mounted on an x-ray transparent x-y translation stage 4. An x-ray source 6 is mounted below sample 2 so that its x-ray beam 8 is directed through target 2 to scintillator assembly 55. A portion of the x-ray photons in beam 10 are stopped by target 2 producing a shadow image of target 2 at the illumination surface of scintillation assembly 55. X-ray photons impinging on scintillator assembly 55 produce scintillations in scintillation assembly 55 and light from these scintillations are detected by human eye 12 or video camera 14 through microscopic optical system 16. The image detected by video camera 14 can be displayed on monitor 17. A leaded glass plate assures that human viewers and electronic equipment is not exposed to the x-radiation.

CsI Sandwich

FIGS. 6A through 6D display, in detail, our currently preferred method for fabricating the scintillator assembly 55. It is very important to produce scintillators having a very good optical quality reflecting surface. This is a problem because producing a very flat surface on CsI crystals is difficult. We use a 7 cm×7 cm 0.25 cm thick optically transparent single crystal scintillator 94. The preferred scintillator material is a thallium-doped cesium diode CsI (Ti) crystal which is surfaced on both sides to the thickness dimension desired (in this case about 0.25 cm) using a diamond fly cutting procedure or any other procedure which produces an optical quality surface with less than about 100 angstroms of surface roughness and preferably less than about 40 angstroms. We then bond an optical quality polycarbonate plate 95, which is about 0.40 cm thick, to the CsI crystal. We choose an optical grade adhesive 10 which is index-matched as well as possible to the CsI index of refraction. A preferred adhesive is Summers Labs UV74 mixed with 9-vinyl carbazole monomer which is cured with UV light. Its index of refraction when cured is 1.6. The polycarbonate plate 95 provides structural rigidity over the entire surface area of the crystal. The index of refraction of the polycarbonate plate (1.59) closely matches that of the CsI crystal and the adhesive closely matches both materials. Therefore, we minimize light scatter and other boundary interface artifacts in the final light image. Fresnel reflections at these interfaces cause losses through the sandwich as well as contribute to scattered light that can degrade image quality. A separate 0.1 cm thick sheet of polycarbonate 91 is coated with a thin reflective layer 92, such as aluminum, to provide both very high reflectance of visible light within the crystal and stop any outside light from entering the crystal. The reflector coated side of the polycarbonate sheet 91 is then bonded, using the same adhesive 10, to the top of the CsI crystal 94. Polycarbonate sheet 91 is then machined at the other side to a thickness of about 0.025 cm in order to minimize the attenuation of x-rays passing through the sheet 91. We calculate that greater than 98% of the x-rays striking scintillator assembly 55 pass through the polycarbonate sheet 91 and the aluminum coating 92 and are absorbed in the first 200 microns of the CsI crystal 94 which converts each x-ray photon into a large number of visible light photons. These visible light photons are emitted into a 4 $\pi$ steradians and the photons hitting the reflective coating are reflecting back towards the optical system thus effectively doubling the visible light available for viewing by the eye 12 or the video camera 14. A focused, visible light image representing the attenuation of x-rays through the object being x-rayed is therefore produced at the surface between the scintillator and the reflective coating.

Essential to the usefulness of any general purpose scintillator is adequate structural integrity as well as resistance to any potentially damaging moisture while exposed to expected environmental conditions. The CsI (Ti) and other related crystals are typically hygroscopic and therefore require a barrier between their outer surfaces and nearly all environments. We accomplished this sealing through the implementation of optical-quality polycarbonate plastic plates. Polycarbonate was chosen because its coefficient of thermal expansion (CTE) in addition to its optical indexes is relatively close to that of CsI. However, other transparent materials with similar thermal expansion and optical characteristics may also be used.

The substantially polycarbonate plate 5 which is placed on the optical side of the sandwich is also designed to enhance the structural integrity as well as seal out the moisture. The plate is relatively thick (~4 mm) and is anti-reflection coated with coating 98 to minimize Fresnel reflections from its outer surface. As indicated by the following formula, optical indices of adjoining materials should be closely matched to reduce unwanted reflections.

$$R = \frac{(n_1 - n_2)^2}{(n_1 + n_2)^2}$$

where $n_1$—index of material 1, $n_2$=index of material 2 and R is the Fresnel reflection.

For our CsI crystal, the index of refraction at the peak scintillation wavelength (of 550 nm) is 1.793. The index of refraction for our optical adhesive is 1.6. This gives a Fresnel reflection of about 0.4% at the x-ray illumination surface of the crystal. It is important that this reflection be kept low especially at this junction. The reflection here should preferably be kept less than about 0.5%. For some applications we have learned that the reflection problem can become acute if the Fresnel reflection exceeds about 1%.

The overall thickness of our preferred scintillation sandwich is slightly larger than 3.5 mm consisting of the following layers starting at the x-ray incident side:

| | |
|---|---|
| Polycarbonate Top Layer | 0.25 mm |
| Aluminizing Reflector Layer | 0.01 mm |
| Optical Adhesive | 0.05 mm |
| CsI Crystal | 1.50 mm |
| Optical Adhesive | 0.05 mm |
| Polycarbonate Bottom Layer | 4.00 mm |
| Anti-Reflectant Coating | 0.01 mm |

Our single-crystal scintillator provides substantial advantages over prior art dendritic (needle-type) crystals. Better x-ray conversion is also possible due to the allowable thicker scintillator depth, before degrading resolution beyond a useable extent. Use of a single-crystal (as opposed to needle-type crystal which must be very thin for good resolution) permits us to focus the optical portion of our camera system at the reflector—CsI interface 10 (in FIG. 6C). This provides an extremely good image with very high resolution.

Sandwich with Index Matching Fluid

Figure 8A:
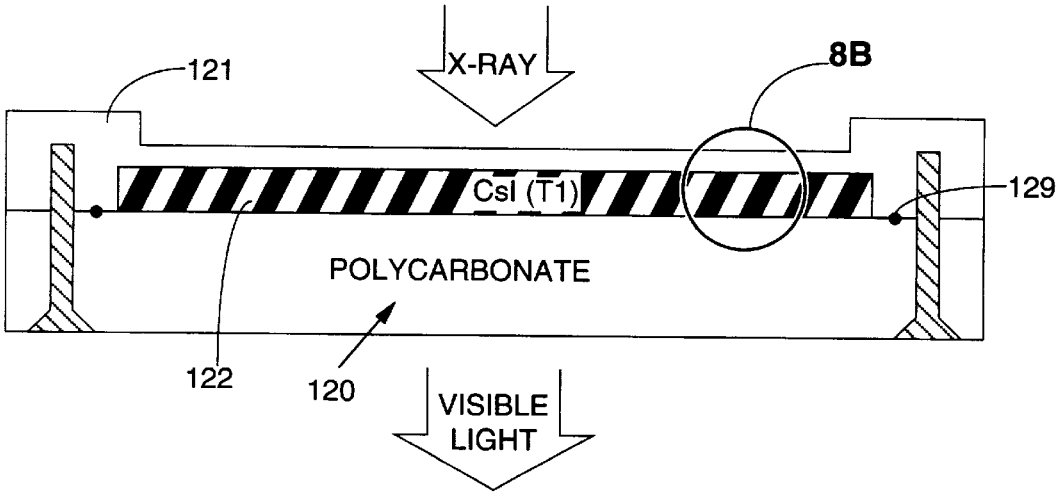
FIGS. 8A and 8B shows how to fabricate a preferred scintillator sandwich.
Figure 8B:
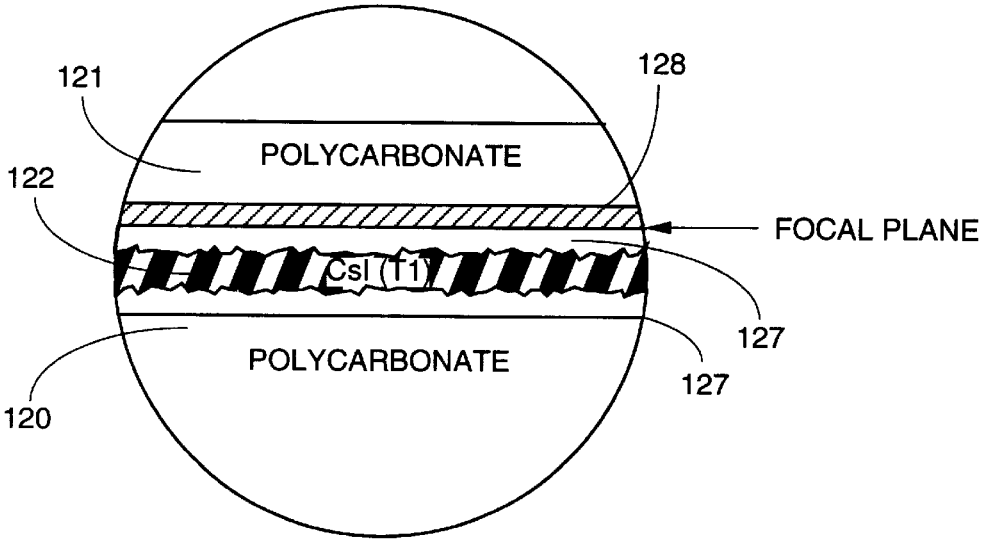

FIGS. 8A and 8B demonstrate another preferred scintillation sandwich incorporating the principals of the present invention. In this case the CsI crystal 122 is contained between polycarbonate base plate 120 and polycarbonate cover plate 121. Cover plate 121 as above is coated with a thin aluminum layer 128 to provide an x-ray transparent optically reflecting surface. The spaces between the crystal and the reflecting surface 128 of cover plate 121 is filled with an index matching fluid having an index refraction almost exactly matching that of the CsI crystal. We used in both spaces Cargille hd=1.70, B-series index matching fluid. The thickness of the fluid was about 20 $\mu$m microns compared to a crystal thickness of about 1.55 mm O-ring 129 assures a good seal. Note in FIG. 8B the thickness spaces filled with the fluid is exaggerated. Note, also we have emphasized the flatness of the mirror surface at the bottom of reflective layer 128 and the jaggedness of the upper and lower surfaces of CsI crystal 122 in order to indicate the importance of the index matching fluid in improving the optical performance of the sandwich. As indicated in FIG. 8B we focus our camera on the reflective surface which provides a very precise image of all scintillations in Crystal 122 including the light reflected off the mirror. Because of the close match of the fluid and the crystal, there are virtually zero reflections from the rough surface of the CsI crystal.

Focusing the Optical System

Figure 7:
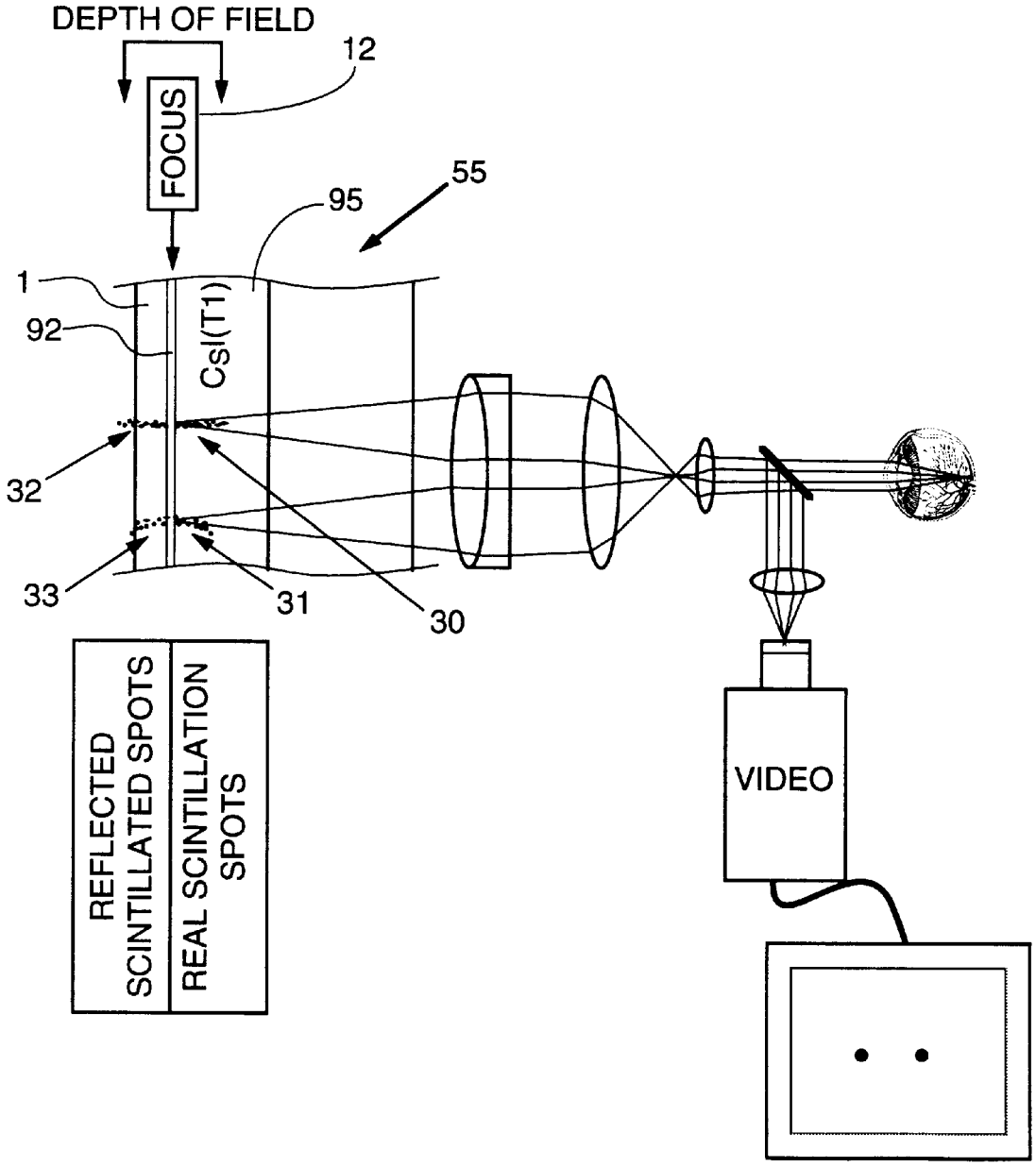
FIG. 7 shows how to focus the camera in a preferred embodiment.

Each x-ray photon typically generates one scintillator spot as it is absorbed in the CsI (Ti) crystal. The most likely absorption location is at the point of x-ray entrance into the crystal, just down stream of aluminum mirror 92. However, many x-ray photons are absorbed at greater depths into the crystal. Spot locations within CsI crystal 95 are depicted at 30 and 31 in FIG. 7 as representing scintillations from x-ray absorptions. Each of these produce real images. Mirror 2 produces virtual images of these spots as represented at 32 and 33 in FIG. 7. Our optical system focal plane is at the mirror—CsI crystal interface as shown at 12 on FIG. 7 and we prefer a depth of field that includes at least 86% of the real and virtual scintillation spots. As shown at 36 in FIG. 7, large numbers of lined up scintillations (real and virtual in scintillator 55, which would be representative of two narrow x-ray passage ways in the object being x-rayed) are imaged as two points on CCD array 40 and show up as two spots on the video monitor as shown in FIG. 7.

Small X-ray Spot

Figure 2A:
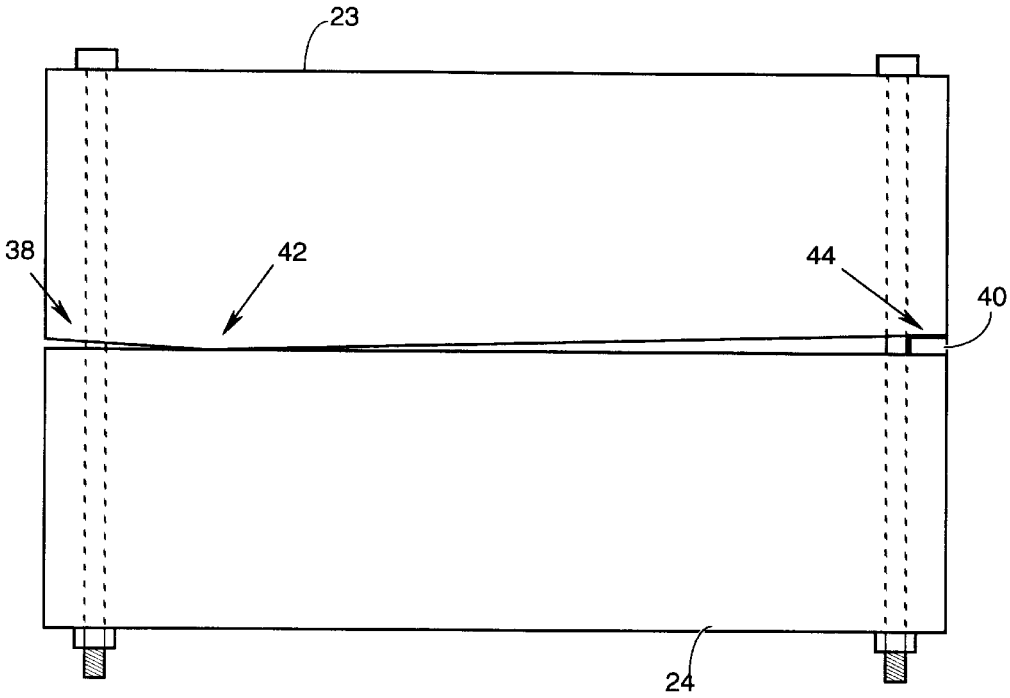
FIGS. 2A and 2B are drawings of a portion of an adjustable pin-hole aperture device.
Figure 2B:
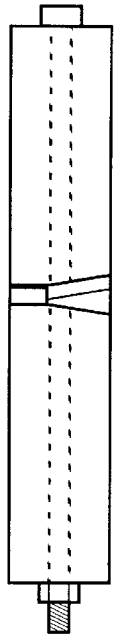

A very small x-ray spot source is needed to provide geometric magnification with high resolution of small target features. These small spots can be produced with a pin hole aperture. FIGS. 2A, 2B, 3A, 3B and 3C describe an adjustable pin hole assembly 30 comprised of two crack plates. FIGS. 2A and 2B are two views of one of the crack plates. The crack plate consists of a first plate 24 which is a generally rectangular plate 2½ inches long, 1 inch wide and ¼ inch thick. A crack edge of first plate 24 is partially tapered as shown in FIG. 2B. The bottom 1/16 inch of the crack edge defines a plane perpendicular to the front and back faces of plate 30 and the upper part of the edge is cut at an angle of about 20° with the perpendicular plane. A second plate 23 is generally the same shape as the first plate except it is provided with a slight taper of about 5° for over the first ⅜ inches of its crack edge as shown at 38 in FIG. 2A. The perpendicular portions of the crack edges of both plates are polished to a surface smoothness of about 50 Å. Two holes of 5/32" diameter are drilled through the first and second plates as shown in FIGS. 2A and 2B and ⅛ inch bolts are inserted to hold the plates together. A shim 40 which is 30 $\mu$m thick is inserted as shown in FIG. 2A and the bolts are tightened to produce a triangular crack which is about zero $\mu$m wide at 42 and 30 $\mu$m wide at 44. (The width of the crack is exaggerated in the figures.) Two of these crack plates are assembled as shown in FIGS. 3A, 3B and 3C to form adjustable pin hole assembly 30. Each crack plate is securely attached and controlled by a separate micrometer, and each plate glides on a track 31 (shown only in FIGS. 3B and 3C) so that the square hole common to the cracks in both plates remains in substantially the same location as the plates are moved back and forth with the micrometers. Thus, square holes with edges from zero to 30 $\mu$m can be created by the adjustment of the micrometers. Various size shims can be used to provide different ranges of hole sizes.

Microscope with Pin Hole Source

Figure 4:
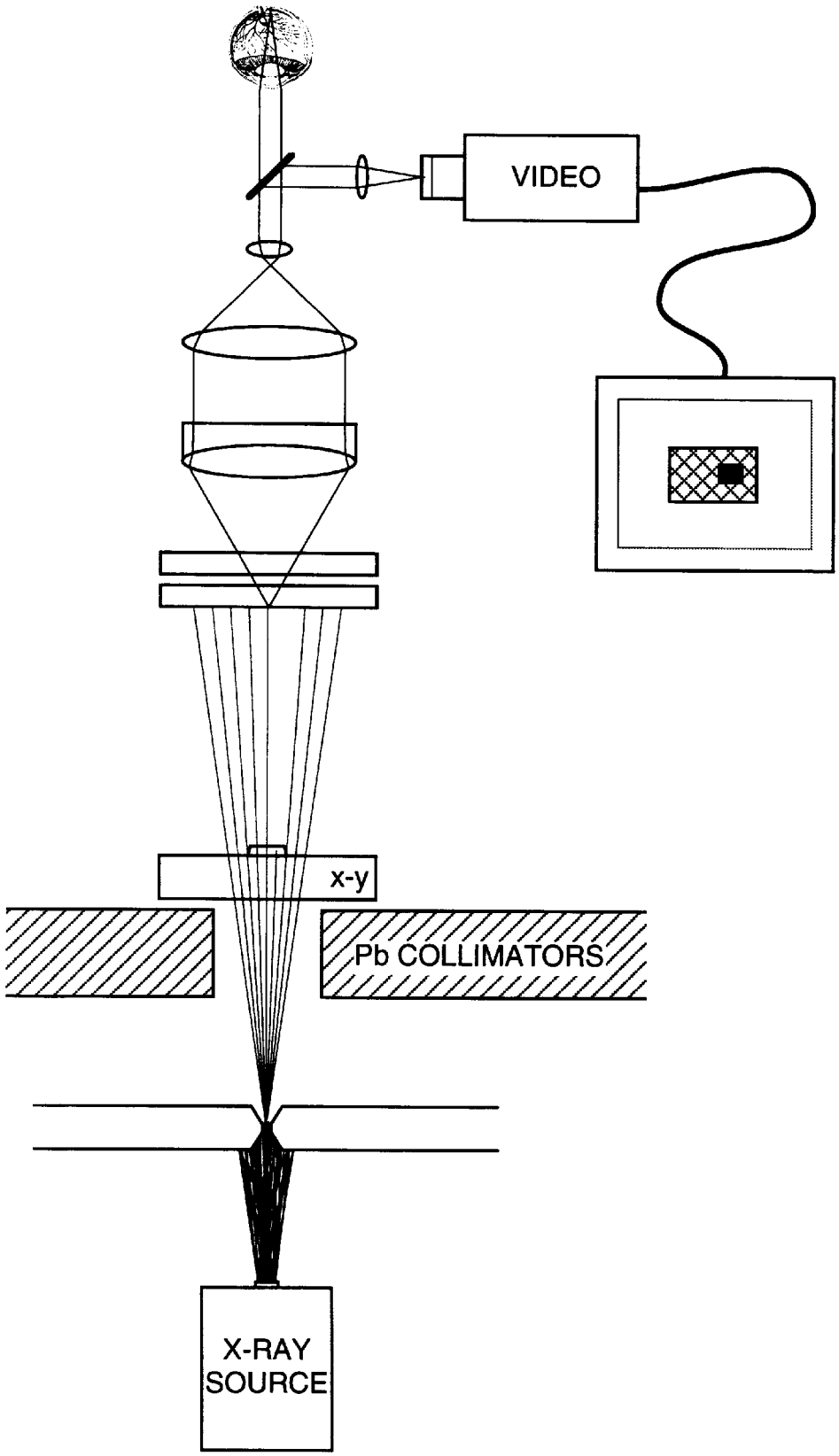
FIGS. 4 and 5 are drawings of a second and third preferred embodiment of the present invention.
Figure 5:
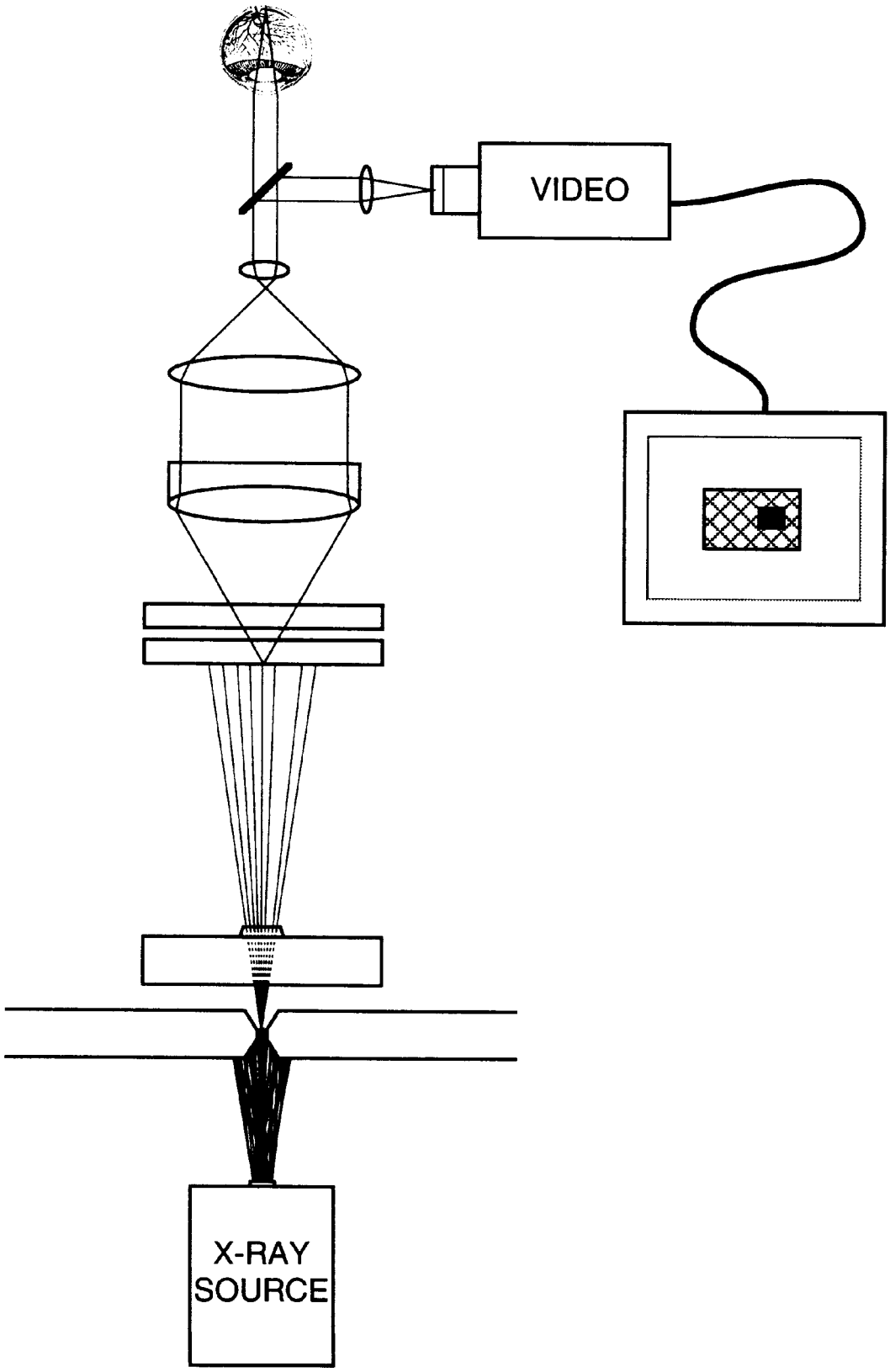
Figure 6A:
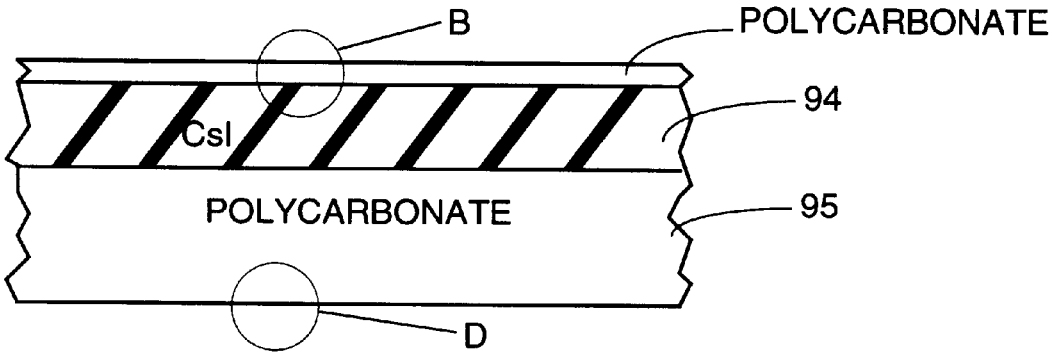
FIGS. 6A and 6B shows the optical configuration of a preferred embodiment.
Figure 6B:
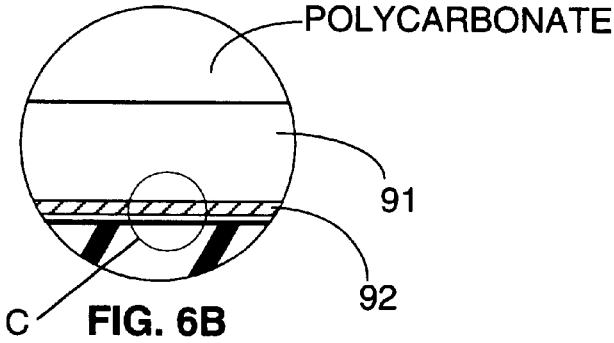
Figure 6C:
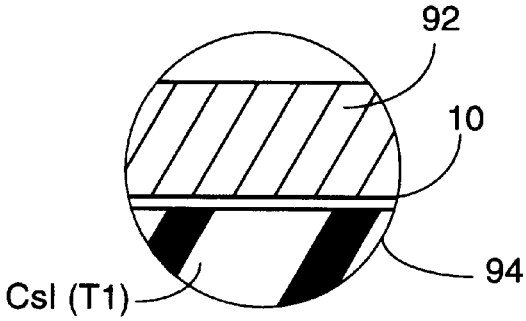
Figure 6D:
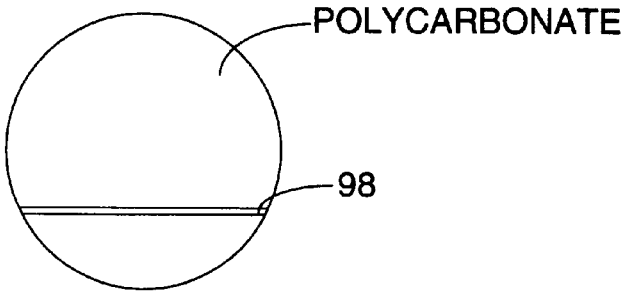

The adjustable pin hole aperture can be incorporated into the microscope system described in FIG. 1 as shown in FIG. 4. Moving the aperture closer to the sample will provide additional geometric magnification as indicated in FIG. 5. Moving the scintillator further away from the sample will also increase the geometric magnification. Very large geometric magnification is possible using this technique. However, for large distances and with low energy x-rays it may be advisable to provide a vacuum between the sample and the scintillator. Note, that the pin hole shown in FIGS. 4 and 5 is somewhat misleadingly shown as an hour-glass shape. Actually the shape of the hole is as portrayed in FIGS. 2A and 2B and FIGS. 3A, 3B and 3C.

High Resolution

The above described scintillator based microscope provides excellent resolution. This excellent resolution is attributable to three special features of this system: (1) the use of x-rays or high energy UV photons to form the basis image, (2) atomic neighborhood size pixel and (3) optical quality of the scintillation crystal.

Short Wavelength

Since a basic limitation on resolution is wavelength related defraction, x-rays and high energy UV have an advantage over visible light when it is necessary to distinguish micron and especially submicron size features.

Atomic Neighborhood Size Pixels

The second basic advantage provided by the above described scintillator based microscope is derived from the utilization of the atomic structure of the crystal to provide the photon detecting pixels. X-ray or high energy UV photons illuminating the illumination surface of the CsI (Ti) crystal undergo a photoelectron collision with an inner shell electron which ejects the electron with substantial energy. This ejected electron then scatters within the atomic structure of the crystal for a distance of a few microns to up to about 100 microns depending on the energy of the illuminating photon. There is a forward directional preference so that the horizontal component of the ejected electron track is much shorter than that of the total track. The ejected electron loses its energy principally by creating electron hole pairs along its track. These holes and electrons then move about within the crystal until they are captured within an atomic structure. Holes move reasonably freely through the CsI structure but are trapped when it passes sufficiently near a Ti atom. Visible light is produced when a Ti atom which has trapped a hole also traps an electron and they combine releasing visible light energy. The net result is that visible light is produced very near the point at which the illuminating photon underwent the photoelectron event. Thus, the size of each pixel is on the order of the atomic dimensions of the neighborhood surrounding each event.

Optical Quality Crystal

The third special feature of this microscope system results from Applicants' ability to create a high quality optical element out of CsI (Ti) salt crystals. By polishing the surfaces of the crystal and greatly minimizing Fresnel reflection, Applicants are able to look through the crystal at the illumination-reflection surface of the crystal with their eyes and the visible light detecting optical devices with no significant distortion. Using standard microscopic optical elements, Applicants are able to resolve the light produced in the crystals down to less than 5 microns. With geometric magnification, even greater resolution can be achieved. When photons from a very small spot photon source are imaged over long periods of time, Applicants expect to be able to image details in the Angstrom range.

Microscope Optical Design

For many applications, the optical objective 16 for collecting the light generated in the scintillator is preferably a very low f/#, high numerical aperture objective, in order to optimize the system efficiency, preferably on the order of f/1.0 (N.A.=0.5) or faster. This is especially important when viewing the target with the naked eye and when operating with a very tiny point source for providing high resolution geometric magnification. In addition, the objective preferably is achromatized due to the broadband spectrum of the CsI (Ti) scintillation and well-corrected over the entire field-of-view to retain the inherently high resolution of the crystal. Several commercially available microscope objectives meet these requirements. Two such commercially available optical microscope systems which could be utilized to magnify images produced at the mirror-illumination surface of scintillator 55 are NIKON binocular microscope model #LABPHOT 2 and NIKON model #5MZ-2T. Both of these microscopes are fitted with a camera port for video or microscopic film photography. For higher resolution or for larger fields-of-view and other special situations, a custom optical design may be required as can be designed by persons skilled in the optics art with the current optical CAD programs such as CODE V or ZEMAX.

While the above description contains many specifications, the reader should not construe these as limitations on the scope of invention, but merely as exemplifications of preferred embodiments thereof. Those skilled in the art will envision many other possible variations are within its scope. CCD camera 16 could be any of many commercially available cameras which could produce either digital images or an analog image. An index matching fluid could be used as the interface between the illumination surface of the CsI crystal and the reflective surface of the reflector plate. For example, CARGILLE Company distributes an index matching fluid that closely matches the index of refraction of CsI the scintillator sandwich can be made as large as available crystal permits. Accordingly, the reader is requested to determine the scope of the invention by the appended claims and their legal equivalents, and not by the examples which have been given. Crystals as large as 24 inches by 24 inches are currently available, with some significant defects. Good quality crystals as large as 12 inches by 12 inches are currently available.

We claim:

1. A scintillator based microscope image system comprising:

a) a source of high energy photons;

b) a substantially rigid optically transparent support plate;

c) a single crystal scintillation crystal in the form of a crystalline plate defining a peak scintillation wavelength and mounted on said support plate, said scintillation crystal defining an illumination surface and a viewing surface, said illumination surface being covered with an optical reflector to define an optically reflecting illumination surface, and both viewing surface and said optically reflecting illumination surface being treated to reduce Fresnel reflections in said crystal at said peak scintillation wavelength to less than about 1.0 percent and to reduce surface roughness to less than about 100 angstroms;

wherein high energy photons from said source are directed through a target to illuminate said optically reflecting illumination surface to produce an image of said target at or near said optically reflecting illumination surface, directly from light created in said crystal and indirectly from light created in said crystal and reflected from said optical reflector; and d) optical microscopic elements for producing a magnified view of said image at or near said optically reflecting illumination surface.

2. A microscope system as in claim 1 wherein said scintillation crystal is a single crystal CsI crystal.

3. A microscope system as in claim 1 wherein said CsI crystal is doped to produce a CsI (T1) crystal.

4. A microscope system as in claim 1 wherein said optical reflector is attached to said scintillation crystal with an optical grade adhesive.

5. A microscope system as in claim 4 wherein said scintillation crystal has a crystal index of refraction at said wavelength and said optical grade adhesive defines an adhesive index of refraction at said wavelength, said peak scintillation wavelength crystal index of refraction and said adhesive index of refraction being similar enough to reduce Fresnel reflections at said illumination surface to less than about 0.5%.

6. A microscope system as in claim 1 and further comprising an index matching fluid contained between said illumination surface and said optical reflector.

7. A microscope system as in claim 1 wherein said high energy photon source is an x-ray source.

8. A microscope system as in claim 1 wherein said high energy photon source is a high energy ultraviolet source.

9. A microscope system as in claim 1 wherein said high energy photon source is a gamma ray source.

10. A microscope system as in claim 7 and further comprising an adjustable pin hole unit to provide a simulated point high energy photon source.

11. A microscope system as in claim 10 wherein said adjustable pin hole unit comprises two sets of two spaced apart plates each set defining a narrow crack with varying widths.

12. A device for producing microscopic images comprising:

a) a substantially rigid optically transparent support plate;

b) a single crystal scintillation crystal in the form of a crystalline plate, defining a peak scintillation wavelength, mounted on said support plate, said scintillation crystal defining an illumination surface and a viewing surface said illumination surface being covered with an optical reflector transparent to high energy photons to define an optically reflecting illumination surface, and both viewing and said optically reflecting illumination surface being treated to reduce Fresnel reflections in said crystal at said peak scintillation wavelength to less than about 1.0 percent and to reduce surface roughness to less than about 100 angstroms;

c) an optical microscopic system for viewing said image at or near said optically reflecting illumination surface.

13. A device as in claim 12 wherein said scintillation crystal is a single crystal CsI crystal.

14. A device as in claim 12 wherein said CsI crystal is doped to produce a CsI (T1) crystal.

15. A device as in claim 12 wherein said optical reflector is attached to said scintillation crystal with an optical upgrade adhesive.

16. A device as in claim 15 wherein said scintillation crystal defines a crystal index of refraction at said peak sicntillation wavelength and said optical grade adhesive defines an index of refraction at said peak scintillation wavelength, said crystal index of refraction and said adhesive index of refraction being similar enough to reduce Fresnel reflections at said illumination to less than 0.5%.

17. A device as in claim 12 and further comprising an index matching fluid contained between said illumination surface and said optical reflector.

18. A device for producing a magnified x-ray image of a target comprising:

a) a substantially rigid optically transparent support plate;

b) a single crystal scintillation crystal in the form of a crystalline plate, defining a peak x-ray scintillation wavelength, mounted on said support plate, said scintillation crystal defining an x-ray illumination surface and a viewing surface, said illumination surface being covered with an x-ray transparent optical reflector to define an optically reflecting illumination surface, with index matching fluid covering said viewing surface and contained between said illumination surface and said optical reflector to reduce Fresnel reflections in said crystal at said peak x-ray scintillation wavelength to less than about 1.0 percent;

c) an x-ray source positioned to direct x-rays through said target to produce an image of at least a portion of said target at and near said illumination surface; and d) a microscope for producing a magnified view of said image.

19. A method of making an image of at least a portion of a target utilizing a microscopic optical system and a scintillator comprising a single crystal scintillation crystal in the form of a plate, said scintillation crystal defining an illumination surface, said illumination surface being covered with an x-ray optical reflector transparent to high energy photons and defining an optically reflecting illumination surface, said optically reflecting illumination surface and said viewing surface being treated to reduce Fresnel reflection at each surface to less than about 0.5 percent, comprising the steps of:

a) illuminating said target with a beam of photons having sufficient energy such that a portion of said beam is absorbed in said target and a portion passes through said target to define a shadow x-ray beam; a portion of said shadow x-ray beam passing through said reflector and being absorbed in said crystal to produce visible light scintillations in said crystal; and b) focusing said microscopic optical system at or near said optically reflecting illumination surface to provide a magnified view of said image.

20. A method as in claim 19 and further comprising the steps of producing a simulated point photon source using an adjustable pin hole unit comprised of at least two photon absorbing units, each unit having a narrow crack of varying widths.

21. A method as in claim 20 wherein each of said absorbing units are positionable with a micrometer to provide a variable size simulated source.

* * * * *